United States Patent [19]

La Bonte et al.

[11] Patent Number: 4,550,622

[45] Date of Patent: Nov. 5, 1985

[54] PLURAL-AMPLITUDE VIBRATION ASSEMBLY

[75] Inventors: David E. La Bonte; Kurt W. Richter, both of Shippensburg; Robert F. Goehler, Greencastle, all of Pa.

[73] Assignee: Ingersoll-Rand Company, Woodcliff Lake, N.J.

[21] Appl. No.: 493,995

[22] Filed: May 12, 1983

[51] Int. Cl.[4] ..... B06B 1/16

[52] U.S. Cl. ..... 74/87; 74/61; 366/116; 366/128

[58] Field of Search ..... 74/61, 87; 209/366.5, 209/367; 366/116, 128; 404/117

[56] References Cited

U.S. PATENT DOCUMENTS

| | | | |
|---|---|---|---|
| 1,879,923 | 9/1932 | Deister | 74/61 |
| 1,943,076 | 1/1934 | Jackson | 74/61 |
| 3,097,537 | 7/1963 | Peterson | 74/61 |
| 3,722,381 | 3/1973 | Tuneblom | 74/87 X |

FOREIGN PATENT DOCUMENTS

| | | | |
|---|---|---|---|
| 1158429 | 11/1963 | Fed. Rep. of Germany | 74/87 |
| 1987978 | 5/1966 | Fed. Rep. of Germany | 74/87 |

*Primary Examiner*—Allan D. Herrmann
*Attorney, Agent, or Firm*—B. J. Murphy

[57] ABSTRACT

In the embodiment shown, the assembly comprises a pair of apertured weights mounted on a rotatable shaft, each of the weights having abutment surfaces one or another pairs of which close upon each other, depending upon the direction of shaft rotation. One of the weights is keyed to the shaft to rotate therewith; the other weight is freely rotatable relative to the shaft. Upon rotation of the shaft in a first direction, a first pair of the abutment surfaces engage, and the eccentricities of the weights then are so disposed as to produce a given-amplitude vibratory force. Upon rotation of the shaft in a contrary direction, a second pair of the abutment surfaces engage, and the eccentricities of the weights then are so disposed as to produce a vibratory force of a differing amplitude.

11 Claims, 3 Drawing Figures

PLURAL-AMPLITUDE VIBRATION ASSEMBLY

This invention pertains to vibration-producing assemblies and devices, and in particular to vibration-producing assemblies capable of providing, selectively, a plurality of vibration amplitudes.

Assemblies of the aforesaid type which are known in the prior art are commonly of complex and involved structures which incur unwarranted expense in manufacture, and do not lend themselves to facile maintenance. Typical of these is the Dual Amplitude Vibration Generator, disclosed in U.S. Pat. No. 3,722,381 which was issued to Eskil Tuneblom on 27 Mar. 1973. The patentee's Generator has a first eccentric weight welded to the input rotary shaft, and a second eccentric weight with a pair of rings astride the first weight and in freely rotatable circumscription of the shaft. As noted, the first weight is welded to the shaft; the eccentric portion of the second weight is welded to the rings. Repair and replacement, of course, requires replacement of the shaft. Too, the manufacture of the several discrete components is expensive, as well as the time-consuming assembly and welding thereof in place in a machine.

It is an object of this invention to disclose a greatly simplified assembly of inexpensive manufacture and ease of installation and replacement.

Specifically, then, it is an object of this invention to set forth a plural-amplitude vibration assembly, for use in vibratory, surface compactors and the like, comprising: first and second apertured, eccentric weights; a rotatable shaft in penetration of both of said weights; and means engaging said shaft retaining said weights on said shaft; wherein each of said weights has a recessed land formed therein; said lands are confrontingly nested together; one of said weights and said shaft have engaging means interposed therebetween to cause said one weight to rotate in common with said shaft; and the other of said weights is freely rotatable relative to said shaft.

Further objects of this invention, as well as the novel features thereof, will become more apparent by reference to the following description taken in conjunction with the accompanying figures, in which.

Figure 1:
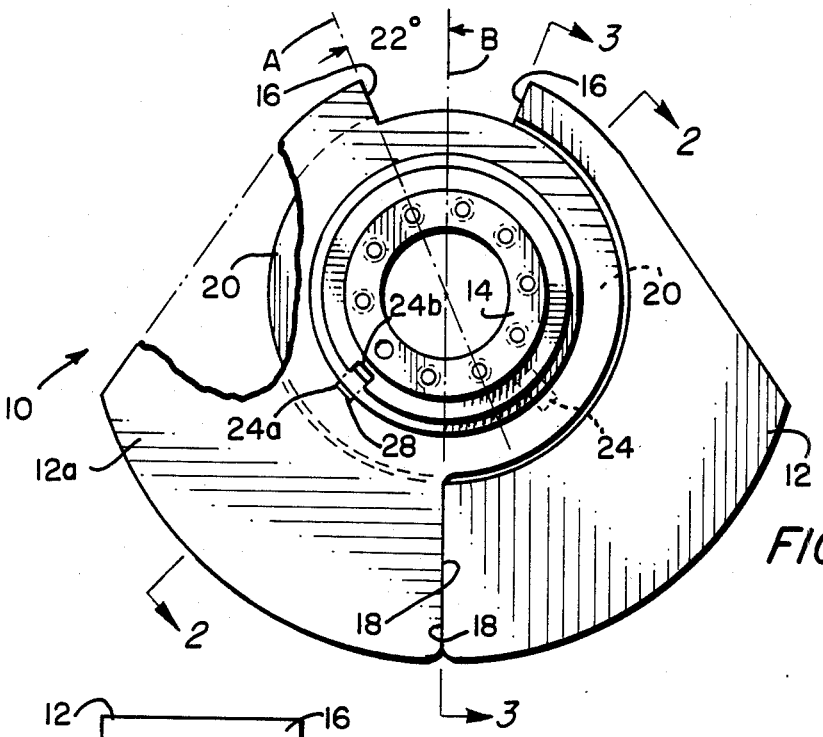
FIG. 1 is an elevational view of an embodiment of the invention, part of the keyed weight having been broken away for purposes of clarification.
Figure 3:
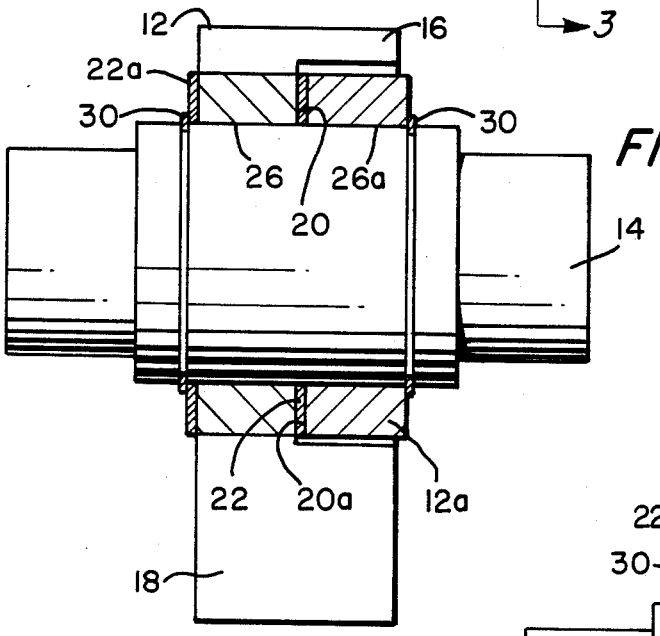
FIG. 3 is a cross-sectional view taken along section 3—3 of FIG. 1.
Figure 2:
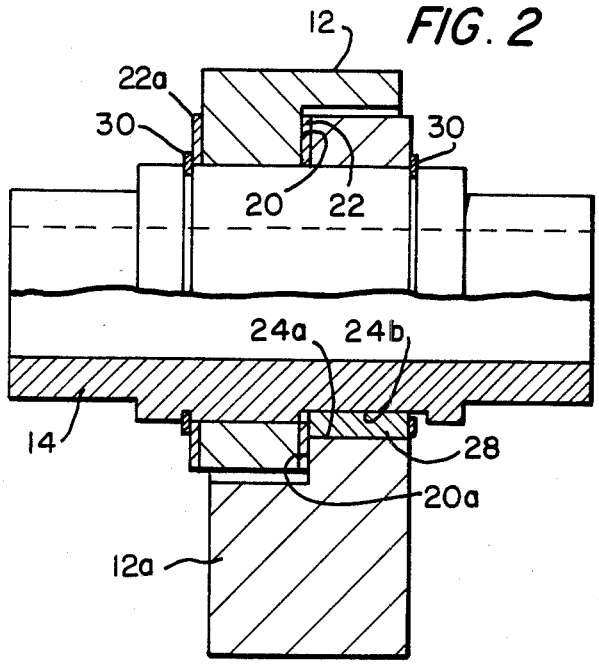
FIG. 2 is a cross-sectional view taken along section 2—2 of FIG. 1.

As shown in the figures, an embodiment 10 of the novel vibration assembly comprises a pair of apertured, eccentric weights 12 and 12*a* mounted on a rotatable shaft 14. Each weight has a pair of flat, abutment surfaces 16 and 18 extending radially inwardly from substantially opposite peripheral surfaces thereof. Each surface 16 of each weight lies in a plane "A" which traverses the plane "B" in which surface 18 thereof lies at an acute angle of from approximately fifteen degrees to thirty degrees of arc, and in the embodiment shown, said planes traverse at an angle therebetween of approximately twenty-two degrees of arc.

Each weight 12 and 12*a* has a recessed land 20 and 20*a*, respectively, such lands being confrontingly nested together and separated therebetween by a thrust washer 22.

Each weight 12 and 12*a* further has a keyway 24 and 24*a* formed therein, within the inside diameter of the shaft-receiving apertures 26 and 26*a* thereof. The shaft 14 has a corresponding keyway 24*b* formed in the outside diameter thereof; the latter keyway 24*b* confronts keyway 24*a* in weight 12*a*, and said confronting keyways receive a key 28 therein. By this means, eccentric weight 12*a* is constrained to rotate in common with shaft 14.

The apertures 26 and 26*a* have diameters which are slightly greater than the outside diameter of the shaft 14. Consequently, weight 12 is freely rotatable on the shaft.

An outermost face of weight 12 is interfaced with a second thrust washer 22*a* and retaining rings 30, set in annular recesses in the shaft 14, secure the assembled weights 12 and 12*a* (and thrust washers 22 and 22*a*) in place on the shaft 14.

In operation, the keyed eccentric weight 12*a* limits the free, rotary travel of the other weight 12. To achieve maximum vibratory amplitude, the input shaft 14 is driven in a counterclockwise direction (as viewed in FIG. 1). This drives the keyed eccentric weight 12*a* through the key 28 which in turn, drives the other eccentric weight 12 through the abutment surfaces 18. Both eccentric weights rotate together with their respective centers of gravity in the closest possible position, thus giving maximum amplitude.

To achieve minimum vibratory amplitude, the shaft 14 is driven in the opposite (clockwise) direction. The keyed eccentric weight 12*a* now rotates until the abutment surface 16 thereof engages the abutment surface 16 of the other eccentric weight 12. Then it drives the latter. The minimum amplitude is dependent upon the angle between the two individual centers of gravity and, thus, by controlling the angle of free movement, the minimum amplitude can be fixed. In the exemplary embodiment 10, an angle of forty-four degrees of arc was chosen to produce one-half the maximum amplitude.

The nesting or mating characteristics of the weights 12 and 12*a* have several advantages. They offer lower manufacturing costs, and the large abutment surfaces 16 and 18 engage under compression instead of bending.

While we have described our invention in connection with a specific embodiment thereof, it is to be clearly understood that this is done only by way of example and not as a limitation to the scope of our invention as set forth in the objects thereof and in the appended claims.

We claim:

1. A plural-amplitude vibration assembly, for use in vibratory, surface compactors and the like, comprising:

first and second apertured, eccentric weights;

a rotatable shaft in penetration of both of said weights; and means engaging said shaft retaining said weights on said shaft; wherein each of said weights has a recessed land formed therein;

said lands are confrontingly nested together in juxtaposition;

one of said weights and said shaft have engaging means interposed therebetween to cause said one weight to rotate in common with said shaft;

the other of said weights is freely rotatable relative to said shaft;

said weights are substantially identical;

said shaft has a given diameter; and said weights each have a shaft-engaging aperture which has an inside diameter which is slightly greater than said given outside diameter, to define a relative slidable interface between said outside diameter of said shaft and said inside diameters of said apertures.

2. An assembly, according to claim 1, wherein:

each of said weights have first and second, flat, radially-directed abutment surfaces extending inwardly from outermost surfaces thereof;

said first abutment surfaces of said weights are mutually confronting; and said second abutment surfaces of said weights are also manually confronting.

3. An assembly, according to claim 2, wherein:

said first abutment surfaces come into mutual contact, upon said shaft being rotated in a given direction, to produce a vibratory force having a given amplitude; and said second abutment surfaces come into mutual contact, upon said shaft being rotated in a direction contrary to said given direction, to produce a vibratory force having an amplitude other than said given amplitude.

4. An assembly, according to claim 2, wherein:

said first and second abutment surfaces of each of said weights are disposed in mutually traversing planes.

5. An assembly, according to claim 4, wherein:

said planes traverse at an angle therebetween of from approximately fifteen degrees to thirty degrees of arc.

6. An assembly, according to claim 4, wherein:

said planes traverse at an angle therebetween of approximately twenty-two degrees of arc.

7. An assembly, according to claim 1, further including:

a thrust washer interposed between said lands.

8. An assembly, according to claim 1, wherein:

each of said weights has a given thickness dimension; and said weights occupy an axial length of said shaft which is not substantially greater than said given dimension.

9. An assembly, according to claim 1, wherein:

said one weight and said shaft have confronting keyways formed therein; and said engaging means comprises a key set in said keyways.

10. An assembly, according to claim 1, wherein:

said weights are identical.

11. An assembly, according to claim 10, wherein:

each of said weights has a keyway formed therein which opens onto said shaft;

said shaft has a keyway formed therein which confronts one of said keyways in said weights; and said engaging means comprises a key set in said confronting keyways.

* * * * *